US008365364B2

(12) United States Patent
Labelson et al.

(10) Patent No.: US 8,365,364 B2
(45) Date of Patent: Feb. 5, 2013

(54) BUCKLE ATTACHMENT DEVICE

(75) Inventors: Ross Labelson, Wesbury, NY (US); Jason H. Dorf, Plainview, NY (US)

(73) Assignee: Buckle-Down, Inc., Westbury, NY (US)

( * ) Notice: Subject to any disclaimer, the term of this patent is extended or adjusted under 35 U.S.C. 154(b) by 367 days.

(21) Appl. No.: 12/656,743

(22) Filed: Feb. 16, 2010

(65) Prior Publication Data

US 2010/0205789 A1 Aug. 19, 2010

Related U.S. Application Data

(60) Provisional application No. 61/202,306, filed on Feb. 17, 2009.

(51) Int. Cl.
*A44B 11/00* (2006.01)

(52) U.S. Cl. ..... 24/163 R; 24/265 EC; 24/265 BC; 24/320; 24/316; 24/343; 24/346; 24/347

(58) Field of Classification Search ..... None
See application file for complete search history.

(56) References Cited

U.S. PATENT DOCUMENTS

| | | | | | |
|---|---|---|---|---|---|
| 1,022,508 | A * | 4/1912 | Rust | 24/265 BC |
| 1,763,100 | A * | 6/1930 | Mendosa | 24/163 R |
| 1,969,582 | A * | 8/1934 | Rosenblum | 24/316 |
| 2,806,275 | A * | 9/1957 | Stoll | 24/265 BC |
| 5,572,747 | A * | 11/1996 | Cheng | 2/322 |
| 5,669,119 | A * | 9/1997 | Seron | 24/265 H |
| 6,108,821 | A * | 8/2000 | Malsoute | 2/321 |
| 6,351,874 | B1 * | 3/2002 | Suggs | 24/265 BC |
| 7,480,967 | B2 * | 1/2009 | Kojoori et al. | 24/163 R |

* cited by examiner

*Primary Examiner* — Jack W. Lavinder
(74) *Attorney, Agent, or Firm* — Jones Day

(57) ABSTRACT

A buckle attachment device is provided for removably securing a buckle and a strap to form a unified strap object, such as a belt. The buckle attachment device enables a user to select one of a wide variety of buckles to be coupled with one of a wide variety of straps that may be custom cut to a desired length. The selected buckle and strap are then removably secured by the user to the buckle attachment device without the need for specialized tools or additional binding components.

9 Claims, 4 Drawing Sheets

BUCKLE ATTACHMENT DEVICE

CROSS-REFERENCE TO RELATED APPLICATIONS

The present application claims priority to U.S. Provisional Application No. 61/202,306, filed on Feb. 17, 2009, the contents of which are herein incorporated by reference, in its entirety.

BACKGROUND

1. Field of the Disclosure

The present disclosure relates generally to a buckle attachment device. More specifically, the present disclosure relates to a buckle attachment device that can be removably secured to a buckle and a strap, thereby coupling the buckle and strap to form a unified strap object, such as a belt.

2. Description of Related Art

Buckles have been used for many years as a relatively simple and inexpensive way for securing straps. A variety of buckles combined with straps in the form of belts exist to provide the utilitarian function of securing pants or other clothes, and many provide aesthetic functions as well. Prior buckle designs, however, lack the ability to accommodate customization by users since most buckle and strap devices, such as belts, are manufactured for specific sizes and incorporate a buckle that is permanently affixed to the belt. If a user wishes to wear a belt with a different buckle, material, color, or length, that user may need to purchase additional belts or perform difficult and/or potentially damaging steps to alter an existing belt. Accordingly, there exists a need to provide a buckle attachment device that enables a user to removably attach, with ease, a wide variety of buckles to many different straps.

SUMMARY

Exemplary embodiments disclosed herein remedy the deficiencies of the prior art by providing a buckle attachment device that enables easy and removable coupling of a buckle with a strap.

In exemplary embodiments, the removability of the buckle from the strap allows retailers to carry one size belt (the longest) belt per particular style. The belt can then be cut to size and attached to buckle attachment device. In exemplary embodiments, this may also allow the belt to be reversible.

Exemplary embodiments disclosed herein provide a buckle attachment device that is easily and removably secured to one of a wide variety of buckles.

Exemplary embodiments disclosed herein provide a buckle attachment device that is easily and removably secured to one of a wide variety of straps.

Exemplary embodiments disclosed herein provide a buckle attachment device that is easily and removably secured to one of a wide variety of reversible straps Exemplary embodiments disclosed herein provide a buckle attachment device that is easily and removably secured to a strap that has been cut to a desired length.

Exemplary embodiments disclosed herein provide a buckle attachment device that is easily and removably secured to a both a wide variety of buckles and a wide variety of straps.

Exemplary embodiments disclosed herein provide a buckle attachment device that is easily and removable secured to a buckle having a removable cover.

Exemplary embodiments disclosed herein provide a buckle attachment device that is easily and removable secured to a buckle having an interchangeable faceplate.

Exemplary embodiments disclosed herein provide a buckle attachment device that is aesthetically desirable when removably secured to a strap and a buckle.

BRIEF DESCRIPTION OF THE DRAWINGS

Additional objects, features, and advantages of the present disclosure will become apparent from the following detailed description of the exemplary embodiments discussed in conjunction with the accompanying drawings where like reference numerals indicate like features, in which.

DETAILED DESCRIPTION OF EMBODIMENTS

FIGS. 1-9 are perspective views of embodiments of a buckle attachment device in accordance with the exemplary embodiments described herein. As an initial matter, it should be noted that while a belt is shown in exemplary embodiments, the present invention may be used with any strap object, including but not limited to, belts, seat belts, shoe straps, clothing accessory straps, and backpacks or other bag straps.

Figure 1:
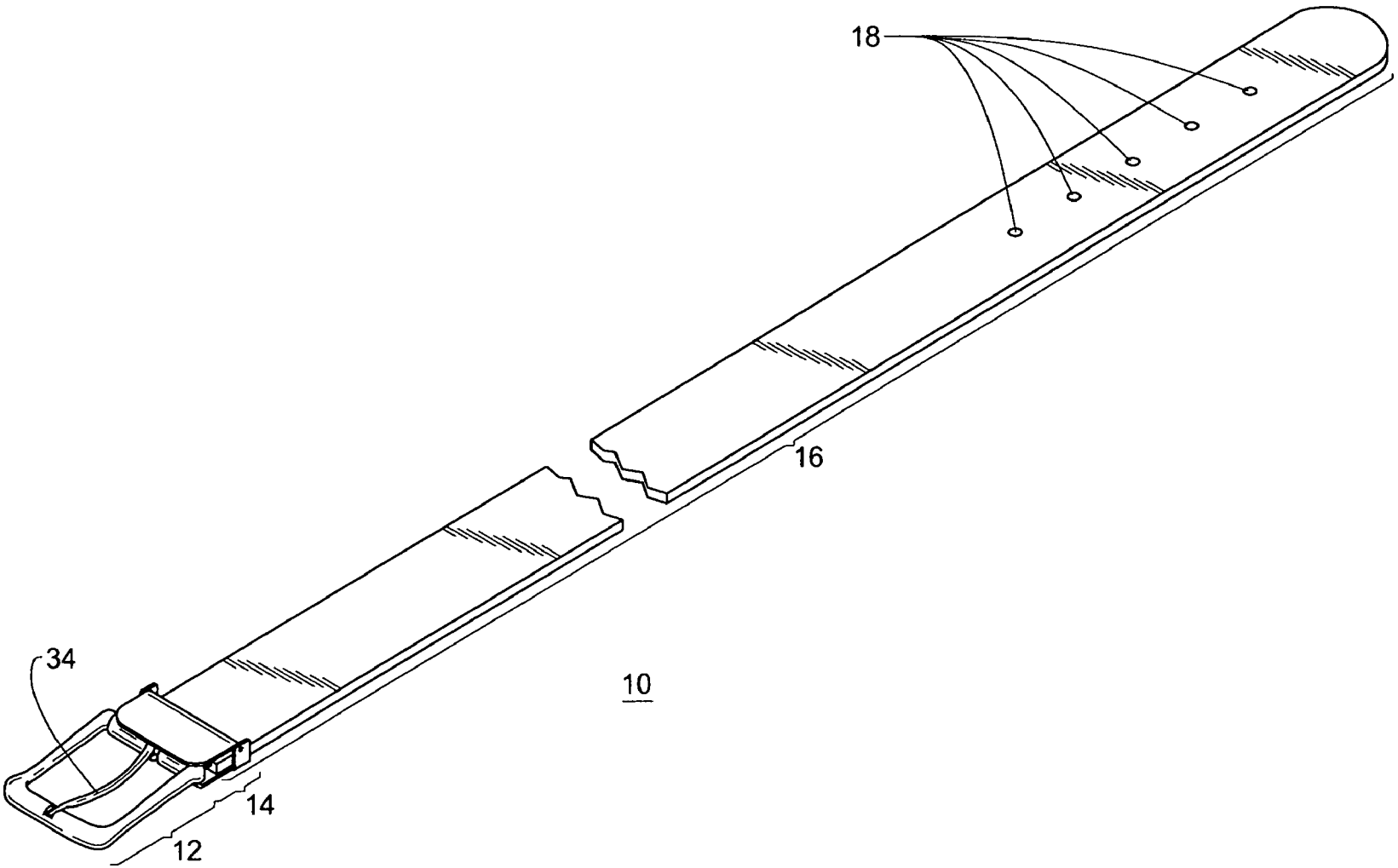
FIG. 1 is a perspective view of a belt comprising a buckle attachment device in accordance with exemplary embodiments.

Referring to FIG. 1, a belt (10) is shown comprising a belt attachment device (14), a buckle (12), and a strap (16). In FIG. 1, the belt attachment device (14) is shown removably secured to the buckle (12) and the strap (16). The strap (16) may comprise any type of material or combination thereof, including, but not limited to leather, vinyl, and/or fabric. The strap (16) may also comprise any width or any length, various thickness, and may be custom cut to fit a particular user at the time of purchase or subsequent to purchase. The strap may also include holes (18) for mating with the fastener (34) of the buckle (12) during use. The buckle (12) may comprise a wide range of materials, shapes, sizes, and styles. In operation, the buckle attachment device (14) fits over a cut end of the strap (16) and is removably secured to both the strap (16) and the buckle (12), as described further below, without the need for specialized tools or additional binding components.

Referring to FIGS. 2, 3, 6 and 7, various views are shown of a buckle (12), a strap (16), and a buckle attachment device (14) prior to, during, and after insertion of the buckle (12) and the strap (16) into the buckle attachment device (14) in accordance with exemplary embodiments.

Figure 2:
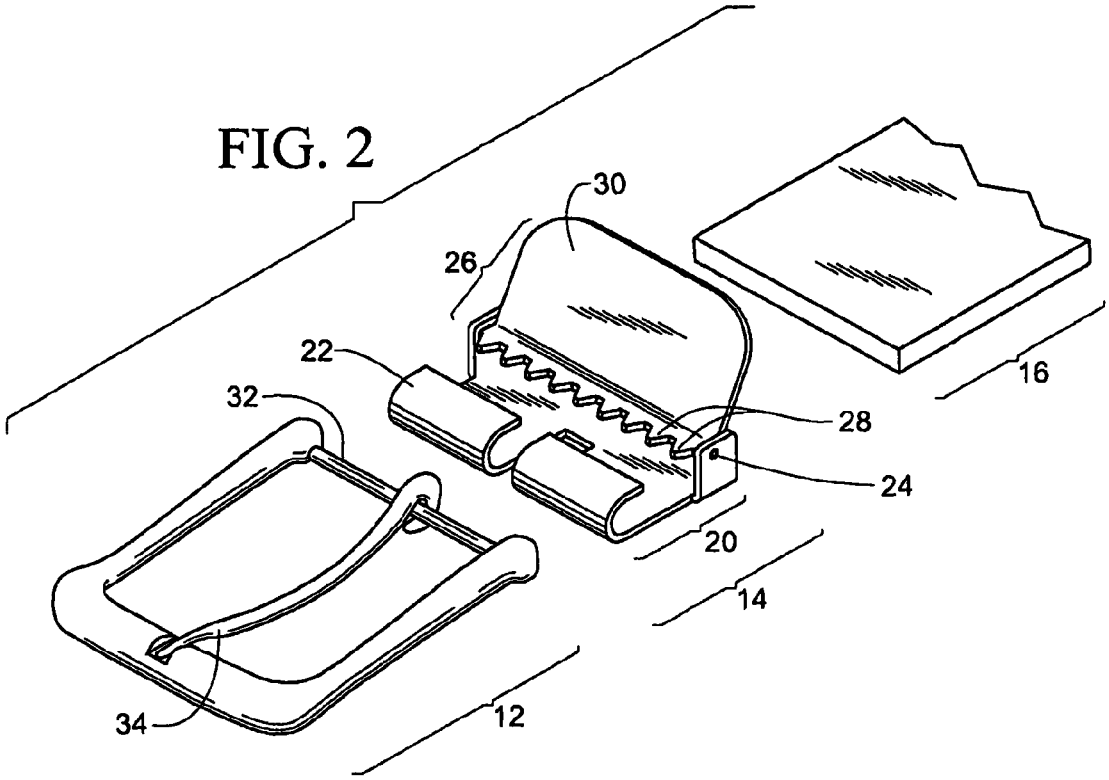
FIG. 2 is a perspective view of a buckle, a strap, and a buckle attachment device prior to removably securing the buckle attachment device in accordance with exemplary embodiments.

Turning first to FIG. 2, shown is a buckle attachment device (14) comprising a curved latching portion (20) rotatably connected to an engaging portion (26) by a hinge (24). The curved latching portion (20) includes a curvature (22) having a radius large enough to receive and removably secure a mounting bar (32) of a buckle (12) of a wide variety of shapes and sizes. The engaging portion (26) includes teeth (28) that provide a frictional force for removably securing the strap (16) to the buckle attachment device (14), as described further below. In order to achieve an even distribution of force at the teeth (28), the strap (16) may comprise a substantially flat end portion that may be cut to a desired length prior to insertion into the buckle attachment device (14). The engaging portion (26) also includes a flap (30) for covering a top portion of the curvature (22) of the curved latching portion (20), as described below, thereby further removably securing the buckle (12) to the buckle attachment device (14).

Figure 3:
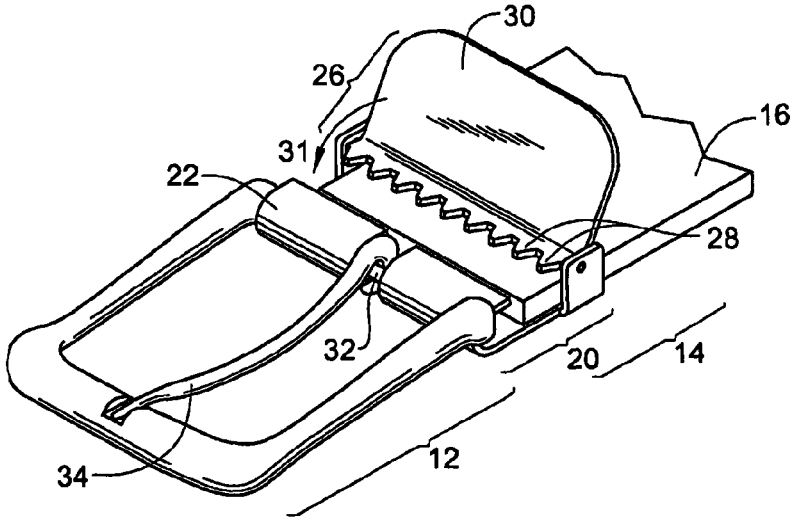
FIG. 3 is a perspective view of a buckle, a strap, and a buckle attachment device upon insertion of the strap into the buckle attachment device in accordance with exemplary embodiments.
Figure 4:
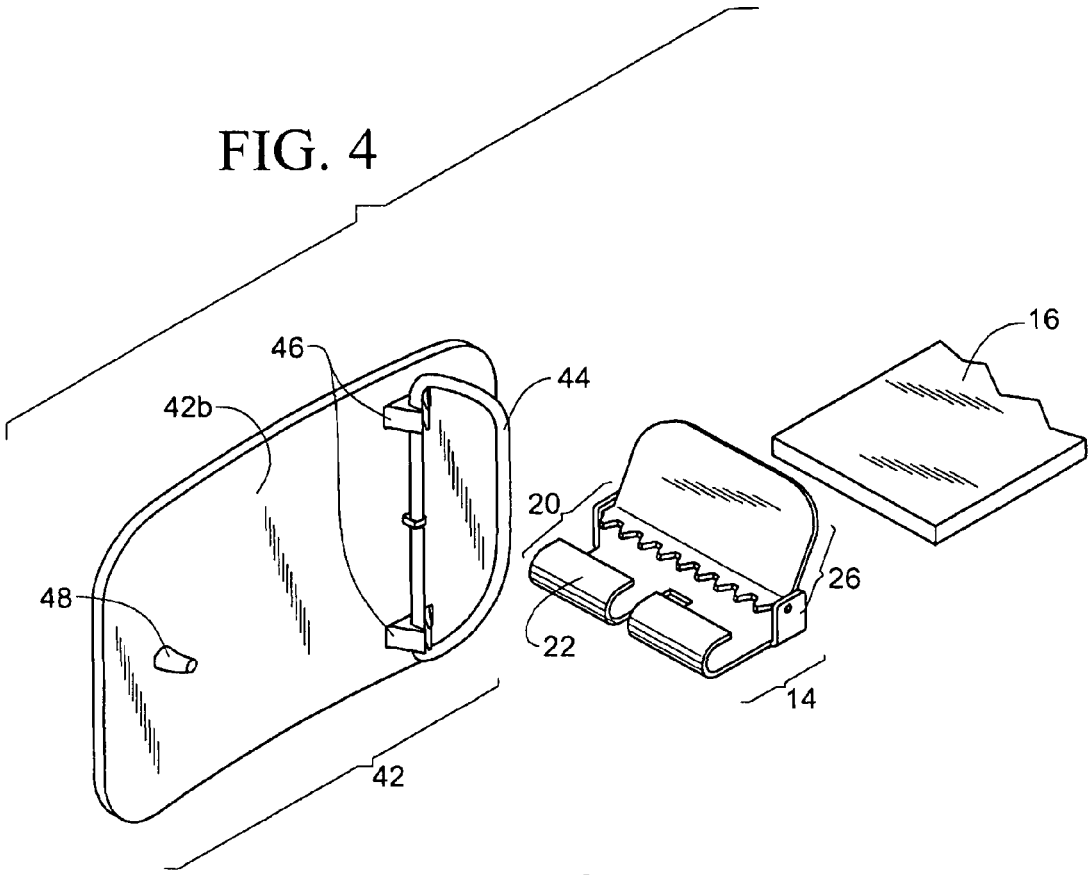
FIG. 4 is a perspective view of a buckle, a strap, and a buckle attachment device prior to removably securing the buckle attachment device in accordance with exemplary embodiments.

FIG. 3 shows a perspective view of the buckle attachment device (14) after the buckle (12) and strap (16) are inserted into the buckle attachment device (14). As shown, a mounting bar (32) of the buckle (12) is removably secured inside the curvature (22) of the curved latching portion (20) which prevents the buckle (12) from disengaging from the buckle attachment device (14) upon receiving a force in a direction extending radially from inside the curvature (22).

After removably securing the buckle (12) to the curved latching portion (20), the engaging portion (26) is positioned with the teeth (28) aligned horizontally and the flap (30) angled in a generally vertical direction so that the cut end of the strap (16) may be inserted into the buckle attachment device (14). The strap (16) is then inserted into the buckle attachment device (14) at least up to a position at the edge of the teeth (28), and in embodiments up to a position beyond the edge of the teeth (28) and approximately up to the end of the curvature (22) of the curved latching portion (20), as shown in FIG. 3, to further removably secure the buckle (12) to the buckle attachment device (14).

Figure 6:
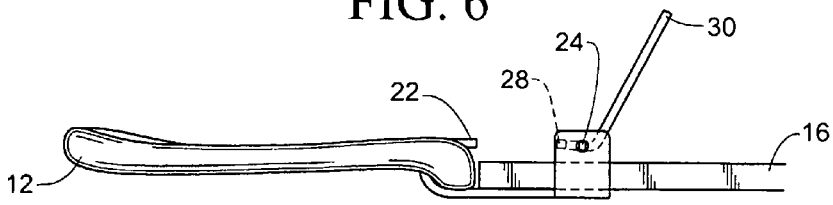
FIG. 6 is a side view of a buckle, a strap, and a buckle attachment device upon insertion of the strap into the buckle attachment device in accordance with exemplary embodiments.

FIG. 6 also shows a view of an alignment of the teeth (28) with respect to the flap (30) at the stage described above in FIG. 3. As shown, the buckle (12) is removably secured at the curvature (22), and the strap (16) is inserted at least up to a position below the teeth (28) and in embodiments up to a position approximately up to the end of the curvature (22). The flap (30) is rotated about the hinge (24) to a generally vertical direction as the teeth (28) are aligned horizontally.

Referring back to FIG. 3, after the strap (16) is inserted to a desired position in the buckle attachment device (14), the flap (30) is rotated in a counter-clockwise direction (31) as shown until the bottom of the flap (30) meets the top of the curved latching portion (20) at the curvature (22). During the rotation (31), the teeth (28) are pressed into the strap (16), thereby removably securing the strap (16) to the buckle attachment device (14).

Figure 7:
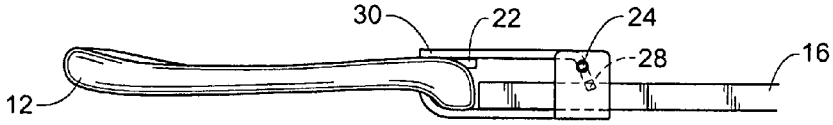
FIG. 7 is a side view of a buckle, a strap, and a buckle attachment device after the buckle and strap are removably secured to the buckle attachment device in accordance with exemplary embodiments.

FIG. 7 shows a perspective view with the flap (30) in a closed position following the rotation (31) about the hinge (24) in a manner as described above regarding FIG. 3. As shown in FIG. 7, the flap (30) covers the top of the curvature (22) while the teeth (28) frictionally engage the strap (16). By covering the top of the curvature (22), the flap (30) provides for further removably securing the buckle (12) to the buckle attachment device (14) as well as provides, in embodiments, a desirable aesthetic look in the form of a covering for the buckle attachment device (14) as shown in FIG. 1. FIG. 1, discussed above, shows the buckle attachment device (14) with the buckle (12) and strap (16) removably secured to the buckle attachment device (14) after the flap (30) has been rotated to a closed position.

Figure 8:
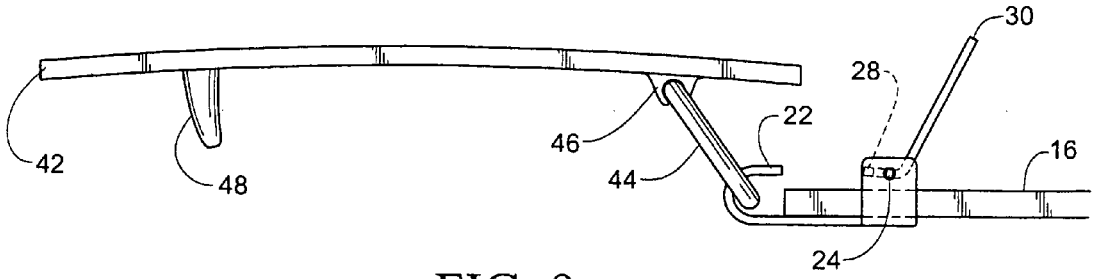
FIG. 8 is a side view of a buckle, a strap, and a buckle attachment device upon insertion of the strap into the buckle attachment device in accordance with exemplary embodiments.

Referring to FIGS. 4, 5, 8 and 9, various views are shown of a buckle (42), a strap (16), and a buckle attachment device (14) prior to, during, and after insertion of the buckle (42) and the strap (16) into the buckle attachment device (14) in accordance with another exemplary embodiment. The buckle (42) shown in FIGS. 4, 5, 8 and 9, includes a peg (48) on the bottom for insertion into a hole (18) located on the strap (16) for circumferentially securing the strap. The top of the buckle (42*a*) may be substantially flat or slightly curved and/or may include various designs, cut-outs, artwork, and/or ornamental features. The bottom of the buckle (42*b*) may be substantially flat or slightly curved to fit relatively flush with the surface of the strap (16) after the strap (16) is circumferentially secured to the buckle (42). A mounting bar (44) is attached to the bottom of the buckle (42*b*) for removably securing the buckle (42) to the buckle attachment device (14) in a manner as described above with respect to FIGS. 2, 3, 6 and 7. Specifically, as shown in FIG. 8, the mounting bar (44) is secured to a clip (46) at one end and to the curvature (22) at another end. The strap (16) is inserted, and the teeth (28) and the flap (30) are positioned about the hinge (24) in a manner as described above regarding FIG. 6.

The various designs, cut-outs, artwork, and/or ornamental features (e.g., a faceplate) may be removably attached to the top of the buckle (42*a*) such that the various designs, cut-outs, artwork, and/or ornamental features are interchangeable with the buckle (42). The manner in which the various designs, cut-outs, artwork, and/or ornamental features may be attached to the buckle (42) should be well known to a person of skill in the art, but in exemplary embodiments, may be attached using, for example, clips, Velcro, temporary adhesive, magnet(s), or any other non permanent means.

Figure 5:
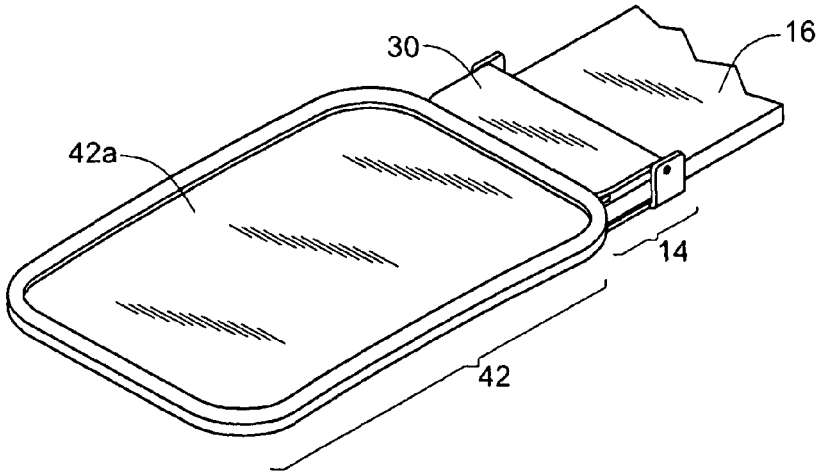
FIG. 5 is a perspective view of a buckle, a strap, and a buckle attachment device after insertion of the strap into the buckle attachment device and after the buckle and strap are removably secured to the buckle attachment device in accordance with exemplary embodiments.
Figure 9:
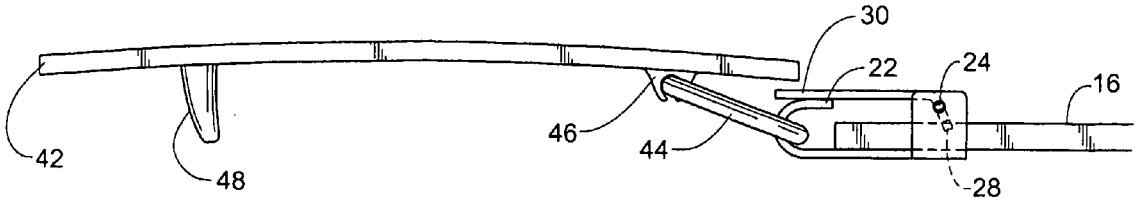
FIG. 9 is a side view of a buckle, a strap, and a buckle attachment device after the buckle and strap are removably secured to the buckle attachment device in accordance with exemplary embodiments.

FIGS. 5 and 9 show the buckle (42) and strap (16) removably secured to the buckle attachment device (14). In a manner as described above with respect to FIGS. 2 and 3, the flap (30) of the engaging portion (26) is rotated (31) to cover the curvature (22) of the curved latching portion (20), and the teeth (28) are forced into the strap (16). Additionally, as shown in FIGS. 5 and 9, the buckle (42) may extend partially or fully over the flap (30) in a closed position, which may further removably secure the buckle (42) to the buckle attachment device (14) by preventing rotation of the flap (30) along the hinge (24) in a direction opposite to the rotation direction (31).

The mounting bar (44) may be secured to the buckle (42) with clips (46) to accommodate removal of the buckle (42) from the mounting bar (44) without opening the flap (30) of the engaging portion (26) which could otherwise require re-securing the strap (16) to the buckle attachment device (14). This configuration enables the simple replacement of a buckle (42) with other buckles having, e.g., different designs, cut-outs, artwork, and/or ornamental features.

Additionally, a lock (not shown) may be provided to further secure the flap (30) of the engaging portion (26) to the top of the curvature (22) of the curved latching portion (20). In embodiments, the lock may be a simple rectangular or curved loop, such as a belt loop, that may be pushed up from the strap (16) and over top of the buckle attachment device (14), encompassing the secured flap (30) and curved latching portion (20) to restrict movement in the hinge (24). The lock may also or alternatively incorporate a magnetic material affixed between, e.g., the flap (30) of the engaging portion (26) and the curvature (22) of the curved latching portion (20). Finally, the lock may also or alternatively incorporate mating locking pins affixed to the engaging portion (26) and the curved latching portion (20) such that the locking pins engage upon closure of the flap (30) onto the curvature (22).

Many alterations and modifications of the present inventions will be comprehended by a person skilled in the art after having read the foregoing description. It is to be understood that the particular embodiments shown and described by way of illustration are in no way intended to be considered limiting. Therefore, references to details of particular embodiments are not intended to limit the scope of the claims, which in themselves recite those features regarded as to the invention.

The embodiments described herein are intended to be illustrative. As will be recognized by those of ordinary skill in the art, various modifications and changes can be made to these embodiments and such variations and modifications would remain within the spirit and scope of the invention defined in the appended claims and their equivalents. Additional advantages and modifications will readily occur to those of ordinary skill in the art. Therefore, the inventions in their broader aspects are not limited to the specific details and representative embodiments shown and described herein.

What is claimed is:

1. A buckle attachment device for removably attaching to a buckle and a strap, said buckle attachment device comprising:

a curved latching portion having a curvature for partially removably securing a buckle to said buckle attachment device, said curvature extending from a bottom portion in a direction substantially parallel to said strap upon insertion into said buckle attachment device and curving inward to a top portion in a direction substantially opposite to said strap upon said insertion so as to prevent said buckle from disengaging from said buckle attachment device upon receiving a force in a direction extending radially from inside said curvature; and an engaging portion for removably securing said strap to said buckle attachment device and for further removably securing said buckle to said buckle attachment device, said engaging portion rotatably affixed to said curved latching portion, said engaging portion further comprising:

teeth for providing a frictional force against a portion of said strap; and a flap for covering said top portion of said curved latching portion upon rotation of said engaging portion to a position where said teeth provide said frictional force, said flap further removably securing said buckle to said buckle attachment device;

wherein said curvature of said curved latching portion comprises a radius large enough to permit said buckle to be removed from said buckle attachment device upon disengaging said teeth from said portion of said strap.

2. A buckle attachment device as claimed in claim 1, wherein said buckle attachment device, said buckle, and said strap comprise one of the following: belt, seat belt, shoe strap, clothing accessory strap, backpack strap, or bag strap.

3. A buckle attachment device as claimed in claim 1, wherein said strap comprises one or more of the following materials: leather, vinyl, and fabric.

4. A buckle attachment device as claimed in claim 1, wherein said buckle comprises a cover having a substantially flat or slightly curved bottom, said cover comprising a peg on said bottom for insertion into a hole located on said strap for circumferentially securing said strap.

5. A buckle attachment device as claimed in claim 4, wherein said cover comprises one or more clips for removably securing a mounting bar, said mounting bar being removably securable to said curved latching portion; wherein said cover may be replaced with a new cover by disconnecting said cover from said mounting bar.

6. A buckle attachment device as claimed in claim 4, wherein said cover extends at least partially over said flap of said engaging portion of said buckle attachment device, thereby further removably securing said buckle to said buckle attachment device.

7. A buckle attachment device as claimed in claim 6, wherein said lock comprises one or more of the following:

(a) rectangular or curved loop for encompassing said engaging portion and said curved latching portion;

(b) magnetic material affixed between said engaging portion and said curved latching portion, and (c) mating locking pins affixed to said engaging portion and said curved latching portion.

8. A buckle attachment device as claimed in claim 1, wherein said buckle includes interchangeable faceplates configured to be coupled to said buckle.

9. A buckle attachment device as claimed in claim 1, wherein said buckle attachment device further comprises a lock for removably securing said engaging portion to said curved latching portion.

* * * * *